US008132876B2

(12) United States Patent
An et al.

(10) Patent No.: US 8,132,876 B2
(45) Date of Patent: Mar. 13, 2012

(54) REFRIGERATOR AND DOOR OPENING APPARATUS THEREOF

(75) Inventors: Jae Koog An, Gwanglu (KR); Clive Good, London (GB); Eun Jung Lim, London (GB)

(73) Assignee: Samsung Electronics Co., Ltd., Suwon-Si (KR)

( * ) Notice: Subject to any disclaimer, the term of this patent is extended or adjusted under 35 U.S.C. 154(b) by 968 days.

(21) Appl. No.: 11/822,382

(22) Filed: Jul. 5, 2007

(65) Prior Publication Data

US 2008/0066481 A1 Mar. 20, 2008

(30) Foreign Application Priority Data

Sep. 19, 2006 (KR) ..... 10-2006-0090724

(51) Int. Cl.
*A47B 96/04* (2006.01)

(52) U.S. Cl. ..... 312/405

(58) Field of Classification Search ..... 312/405, 312/401, 404, 405.1
See application file for complete search history.

(56) References Cited

U.S. PATENT DOCUMENTS

| | | | | |
|---|---|---|---|---|
| 4,090,265 | A * | 5/1978 | Baus | 4/607 |
| 5,220,747 | A * | 6/1993 | Cherry et al. | 49/386 |
| 5,522,656 | A * | 6/1996 | Jenkins | 292/79 |
| 5,702,168 | A * | 12/1997 | Shin | 312/405 |
| 5,906,423 | A * | 5/1999 | Lyu | 312/405 |
| 5,908,228 | A * | 6/1999 | Lee | 312/405 |
| 5,915,805 | A * | 6/1999 | Lee | 312/405 |
| 5,943,967 | A * | 8/1999 | Sherman | 108/102 |
| 6,270,175 | B1 * | 8/2001 | Sfeir | 312/319.9 |
| 6,338,536 | B1 * | 1/2002 | Ueno et al. | 312/405 |
| 6,375,291 | B1 * | 4/2002 | Nam et al. | 312/405 |
| 6,845,545 | B2 * | 1/2005 | Han et al. | 16/277 |
| 7,192,105 | B2 * | 3/2007 | Jung | 312/405 |
| 7,556,324 | B2 * | 7/2009 | Benz | 312/405 |
| 2006/0232176 | A1 * | 10/2006 | Kim et al. | 312/405 |
| 2008/0163462 | A1 * | 7/2008 | King | 16/412 |
| 2008/0282505 | A1 * | 11/2008 | Kim | 16/412 |
| 2010/0270900 | A1 * | 10/2010 | Cho et al. | 312/405 |

FOREIGN PATENT DOCUMENTS

| | | |
|---|---|---|
| KR | 10-2001-0026279 | 4/2001 |
| KR | 10-2005-0115546 | 12/2005 |

* cited by examiner

*Primary Examiner* — Darnell Jayne
*Assistant Examiner* — Timothy M Ayres
(74) *Attorney, Agent, or Firm* — Staas & Halsey LLP

(57) ABSTRACT

A refrigerator with: a main body having at least one storeroom, at least one door hinged to the main body to open and close the storeroom, and a door opening apparatus gradually decreasing a magnetic binding force between the door and the main body as a rotation angle of the door is increased.

19 Claims, 12 Drawing Sheets

REFRIGERATOR AND DOOR OPENING APPARATUS THEREOF

CROSS-REFERENCE TO RELATED APPLICATIONS

This application claims the priority of Korean Patent Application No. 10-2006-0090724, filed on Sep. 19, 2006, in the Korean Intellectual Property Office, the disclosure of which is incorporated herein by reference.

BACKGROUND OF THE INVENTION

1. Field of the Invention

The present invention relates generally to a refrigerator and a door opening apparatus thereof, and more particularly to a refrigerator and a door opening apparatus thereof, in which a user opens a door with weak force, and has a good tactile feeling when opening the door.

2. Description of the Related Art

In general, a refrigerator is designed to supply cold air generated from an evaporator during a refrigeration cycle to a storeroom to allow freshness of various foodstuffs to be preserved for a long time. This storeroom is opened and closed by a door, an inner edge of which is provided with a gasket in which a magnet is mounted, to maintain airtightness of the storeroom when the door is shut.

When the refrigerator is operated in the state where the door is shut, the air in the storeroom is cooled by heat-exchanging with the evaporator. As the air in the storeroom is cooled and condensed, the pressure of the storeroom becomes lower than the atmospheric pressure. In this state, when a user intends to open the door, the user has difficulty in opening the door because the door is pulled with a force greater than just a binding force of the magnet mounted in the gasket and force due to a pressure difference between the outside and the inside of the storeroom. Furthermore, the refrigerator has recently become large, and thus the door has become heavy. Hence, stronger force is required to open the door.

To solve this problem, the applicant of this invention has devised a door handle apparatus for a refrigerator, capable of easily opening a refrigerator door, and has been endowed with Korean Patent Application No. 10-1999-0037523. Here, when a user pulls a handle bar of the door handle apparatus, an operating lever rotates together to push the front surface of a cabinet, and then a gasket, which is attached to a rear surface of the door and is adjacent to the operating lever, is separated from the front surface of the cabinet, so that a gap is generated. The external air flows into the storeroom through this gap, so that the door is easily opened.

This opening operation of the door will be described in greater detail with reference to FIG. 1.

As illustrated in FIG. 1, to rotate the door from the cabinet, the force of the user pulling the door must be gradually increased. As the force of the user pulling the door is gradually increased, the gasket having flexibility is expanded. The moment the force of the user pulling the door reaches a peak (point A), the gasket is separated from the cabinet.

But no force acts between the door and the cabinet from moment the gasket is separated from the cabinet. As such, the door is abruptly open but not smoothly from this time. Therefore, the user's tactile feeling may not be as pleasurable as desired when opening the door.

BRIEF SUMMARY

Accordingly, the present invention has been made to solve above-mentioned problems occurring in the prior art, and an aspect of the present invention is to provide a refrigerator and a door opening apparatus thereof, in which a user opens a door with weak force, and has a good tactile feeling when opening the door.

The foregoing and/or other aspects of the present invention are achieved by providing a refrigerator having: a main body having at least one storeroom, at least one door hinged to the main body to open and close the storeroom, and a door opening apparatus gradually decreasing a magnetic binding force between the door and the main body as a rotation angle of the door is increased.

The foregoing and/or other aspects of the present invention are also achieved by providing a refrigerator having: a main body having at least one storeroom; at least one door hinged to the main body to open and close the storeroom, and provided on a rear surface thereof with a gasket in close contact with the main body when the door is closed; a door handle; operating levers coupled with the door handle, rotationally coupled with the door, and rotating by manipulation of the door handle; and magnets installed on one of the main body and the door, wherein a magnetic binding force between the door and the main body gradually decreases as the door handle is pulled.

The foregoing and/or other aspects of the present invention are also achieved by providing a refrigerator having: a door handle installed to at least one door; operating levers coupled with the door handle, rotatably coupled with the door, and rotating by manipulation of the door handle; coupling units rotatably coupling the operating levers at the upper and lower ends of the door, respectively; and a pair of magnets installed to at least one of a refrigerator main body and the door, and gradually decreasing a magnetic binding force between the door and the main body as the door handle is pulled.

Additional and/or aspects and advantages of the invention will be set forth in part in the description that follows and, in part, will be apparent from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings, of which.

DETAILED DESCRIPTION OF THE PREFERRED EMBODIMENTS

Figure 1:
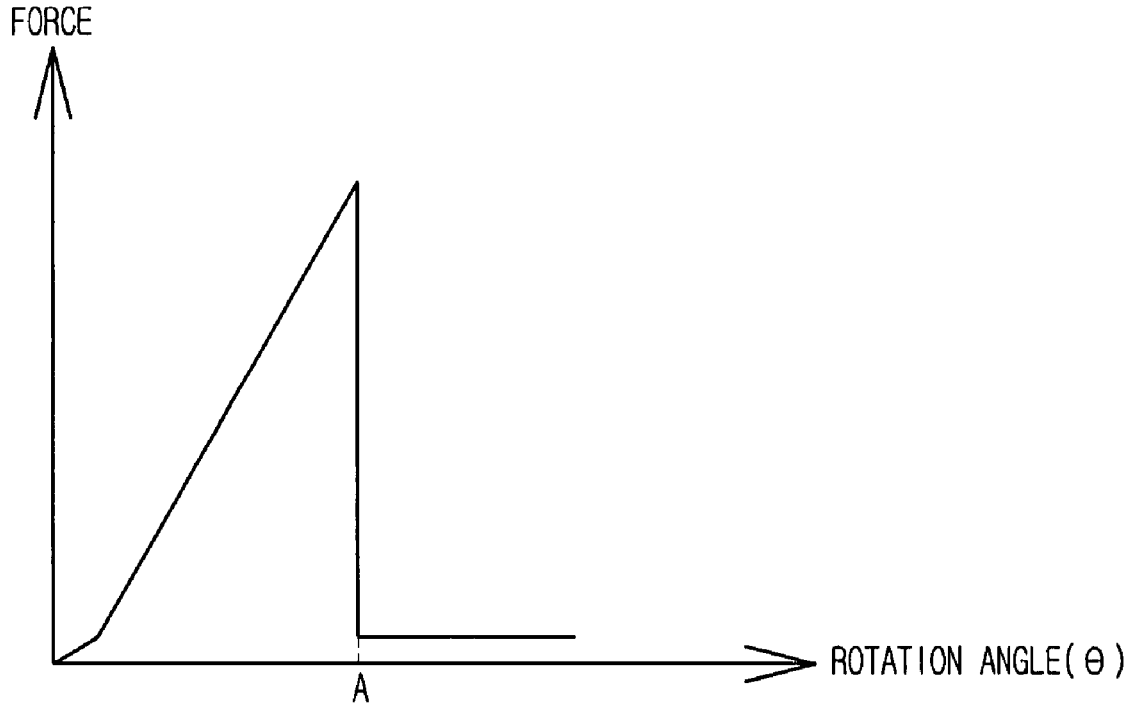
FIG.1 (RELATED ART)
FIG. 1 is a graph illustrating correlation between a rotation angle of a door and a force of a user pulling the door in a related art refrigerator.

Reference will now be made in detail to embodiments of the present invention, examples of which are illustrated in the accompanying drawings, wherein like reference numerals refer to the like elements throughout. The embodiments are described below to explain the present invention by referring to the figures.

Figure 2:
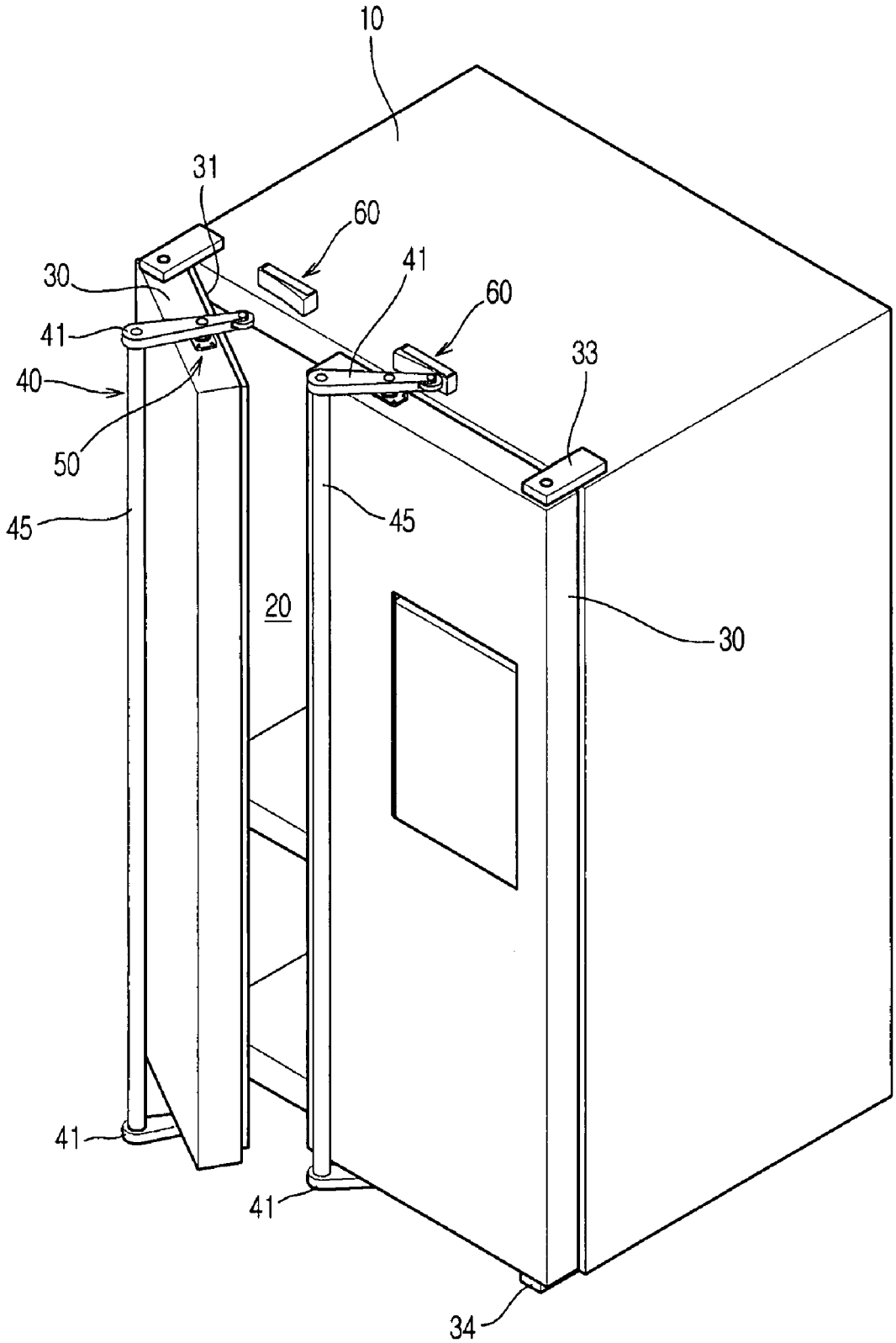
FIG. 2 is a perspective view of a refrigerator according to an embodiment of the present invention.

FIG. 2 illustrates a side-by-side refrigerator to which an embodiment of the present invention is applied. The side-by-side refrigerator includes a main body 10 forming a contour thereof and having a foodstuff storage space, a partition installed in the main body 10 in a longitudinal direction, and storerooms 20 provided on left- and right-hand sides by means of the partition. The main body 10 is provided with a pair of doors 30 for opening and closing the storerooms 20 on left- and right-hand sides thereof.

Each door 30 is rotatably coupled to the main body 10 by means of upper and lower hinges 33 and 34 on upper and lower portions of one side thereof, respectively. Further, each door 30 is provided with a door handle 45 such that a user may easily grasp the door handle 45 to open the door 30. Further, each door 30 is attached with a gasket 31 in which a magnet is housed along the edge of a rear surface thereof, so that a seal between the gasket 31 and the main body 10 is airtightly maintained after the door 30 is closed, and thus cold air in each storeroom 20 is prevented from escaping outside.

This refrigerator is provided with door opening apparatuses 40 to allow the doors 30 to be easily opened when the user pulls the doors 30 with his/her hand.

Each door opening apparatus 40 is installed on opposite sides of respective upper and lower ends of doors 30 from hinges 33 and 34 at each door 30, so that each door 30 easily pivots about the hinges 33 and 34. A detailed structure of each door opening apparatus 40 is as follows.

Figure 3:
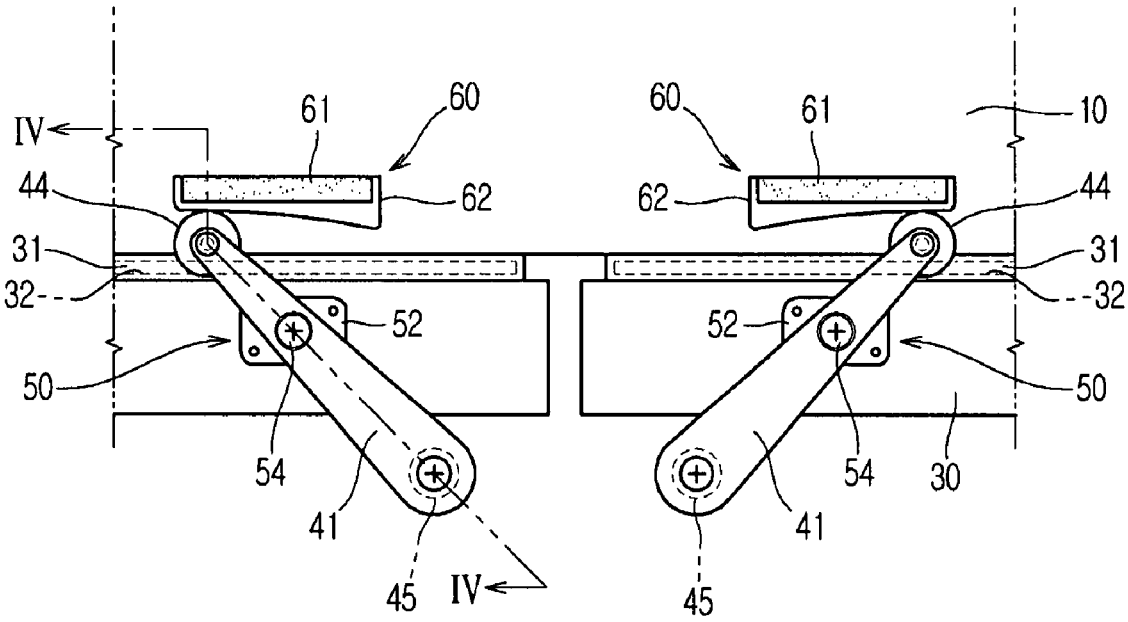
FIG. 3 is a plan view of a door opening apparatus according to an embodiment of the present invention.
Figure 4:
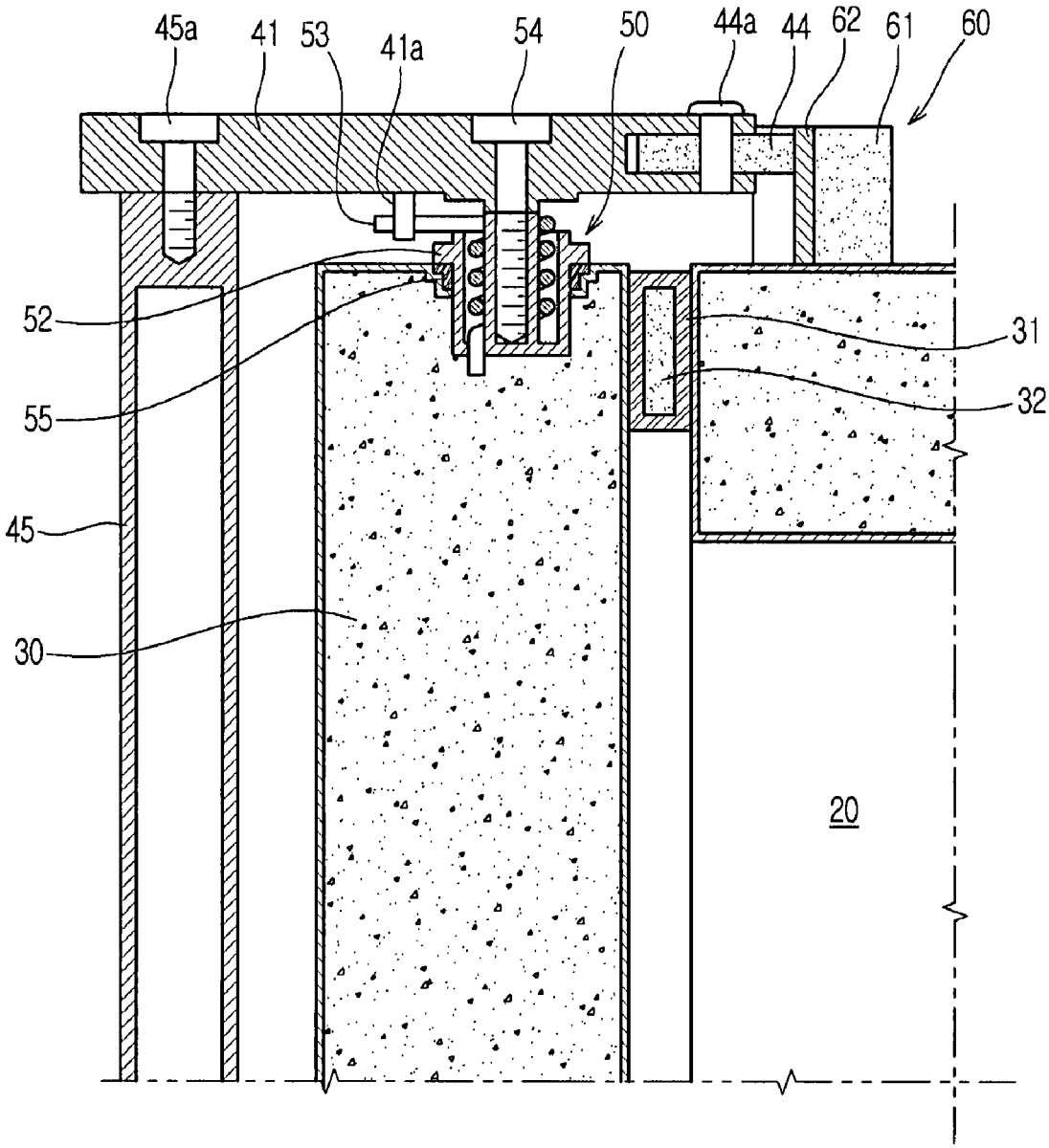
FIG. 4 is a sectional view taken along line IV-IV of FIG. 3.
Figure 5:
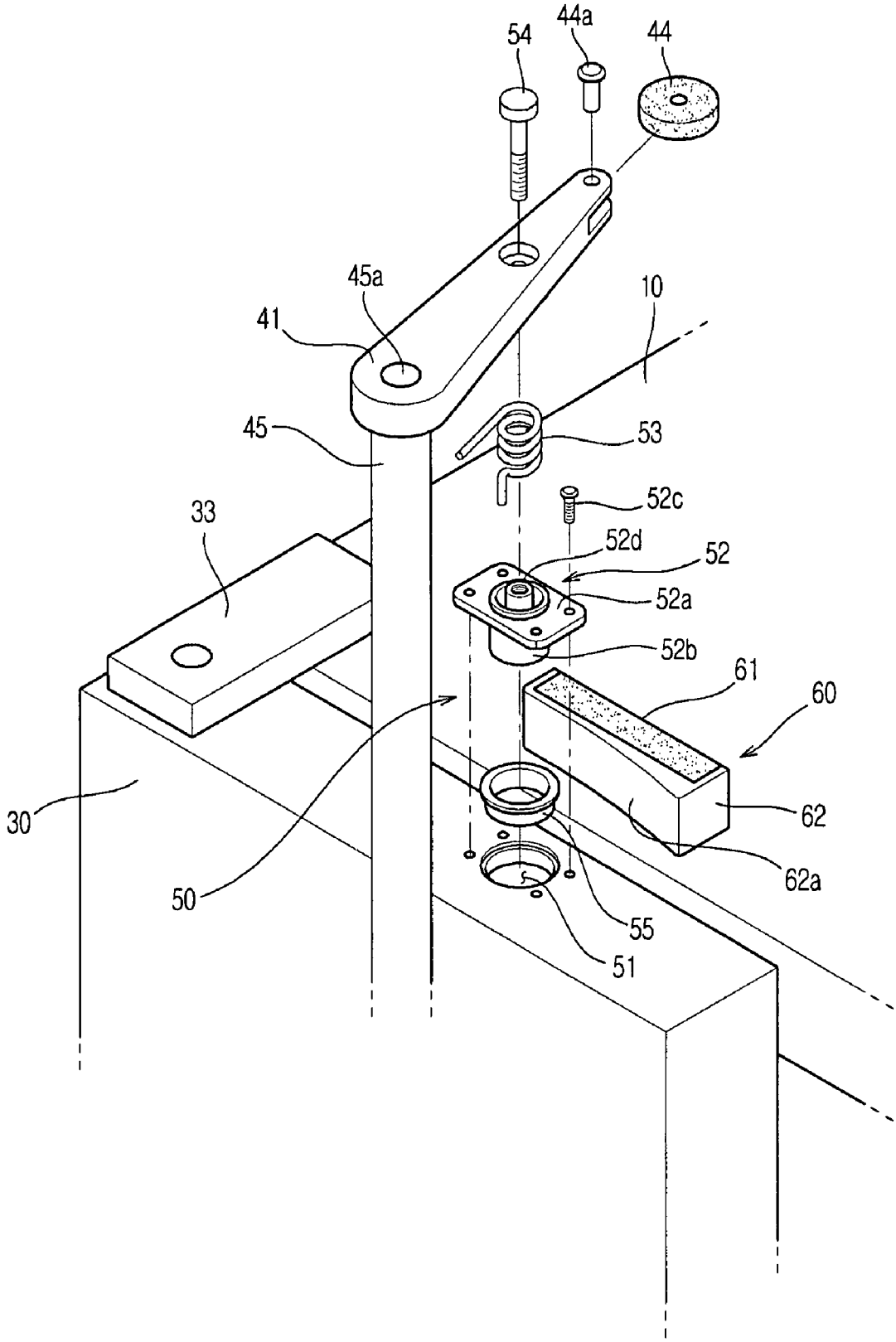
FIG. 5 is an exploded perspective view of the door opening apparatus of FIG. 3.

Referring to FIGS. 3, 4 and 5, each door opening apparatus 40 includes a pair of operating levers 41 disposed, respectively, at the upper and lower ends of each door 30, the door handle 45 connecting the pair of operating levers 41 and being disposed longitudinally in front of each door 30, and coupling units 50 rotatably coupling the pair of operating levers 41 at the upper and lower ends of each door 30.

According to one embodiment, each door handle 45 has the shape of a pipe, and is fixed to the operating levers 41 by bolts 45*a* at opposite ends thereof.

To receive the coupling units 50, a receiving recess 51 is formed in each door 30. The coupling units 50, which rotatably couple the pair of operating levers 41, each include a supporting member 52 fitted into the receiving recess 51 and supporting each operating lever 41, an elastic member 53 installed to the supporting member 52, and a coupling shaft 54 rotatably fixing each operating lever 41. For simplicity, the following description is made with reference to the upper ends of the doors 30 and the main body 10, although it will be understood that the same structures are employed at the lower ends of the doors 30 and the main body 10, merely inverted.

The supporting member 52 includes a flange 52*a* provided on an upper side thereof and having a plurality of holes, and an insert 52*b* provided on a lower side thereof and inserted into the receiving recess 51. The supporting member 52 is fixed to the upper end of each door 30 by a plurality of screws 52*c* after being inserted into the receiving recess 51. In this manner, when the supporting member 52 is inserted into the receiving recess 51, a packing 55 is preferably inserted together with the insert 52*b*.

The insert 52*b* of the supporting member 52 is provided therein with a cylindrical shaft coupler 52*d*, which is concentric with an outer circumference of the insert 52*b* and has a diameter smaller than that of the insert 52*b*. The coupling shaft 54 passing through each operating lever 41 is inserted into the shaft coupler 52*d*. The coupling shaft 54 is provided with a screw thread on a lower portion thereof, and thus is coupled to the shaft coupler 52*d* which has a corresponding female thread, whereas the coupling shaft 54 is not provided with such a screw thread on an upper portion thereof, and thus each operating lever 41 freely rotates about the coupling shaft 54 at each door 30. Further, the elastic member 53, such as a return spring, is fitted around the outer circumference of the shaft coupler 52*d*, thereby endowing an elastic restoring force to each operating lever 41. One end of the elastic member 53 is fixed to a lower end of the supporting member 52, and the other end of the elastic member 53 is fixed to a knob 41 a formed on a lower surface of each operating lever 41. As a result, the elastic member 53 is maintained in place.

Due to this structure, when the user pulls any door handle 45, a rotational moment causing rotation about the coupling units 50 acts on each operating lever 41, and thus each operating lever 41 is rotated.

Further, the door opening apparatus 40 includes a contactor, in this embodiment, a roller 44 that is rotatably coupled to a coupling pin 44*a* on one end of each operating lever 41 and makes a rolling motion when each door 30 is open, and a guide member 60 that is installed on an upper portion of the main body 10 and guides the rolling motion of the roller 44 when the user pulls each door handle 45.

At this time, to allow each door 30 to be opened with weak force, a distance between the door handle 45 and the coupling shaft 54 is longer than that between the coupling shaft 54 and the roller 44.

According to one embodiment, the roller 44 making the rolling motion on one end of the operating lever 41 is formed of a metallic material. The guide member 60 includes a magnet 61 forming a magnetic binding force with the metallic roller 44, and a cover 62 surrounding around the magnet 61 and formed of a non-magnetic substance, such as plastic, (i.e. a substance that is not influenced by magnetic force). The cover 62 has a front inclined surface 62*a* to allow the roller 44 to move away from the magnet 61 when each door handle 45 rotates about the coupling shaft 54. The inclined surface 62*a* is curved to form part of a locus drawn by the roller 44 when the roller 44 rotates about the coupling shaft 54. In the state where each door 30 is shut, the roller 44 is installed to be in contact with the cover 62 at a position where the inclined surface 62*a* begins.

Hereinafter, the operation of the door opening apparatus 40, constructed as above, will be described with reference to FIGS. 3, 6, and 7.

As illustrated in FIG. 2, in the state where each door 30 is shut, magnetic binding force is generated between magnet 32 (in the gasket 31) and the main body 10, and between the roller 44 and the magnet 61, so that the gasket 31 is in close contact with the main body 10, and thus the storerooms 20 are sealed from the outside. In the state where the storerooms 20 are sealed from the outside, when the storerooms 20 are cooled, they are maintained at pressure lower than the atmospheric pressure.

Figure 6:
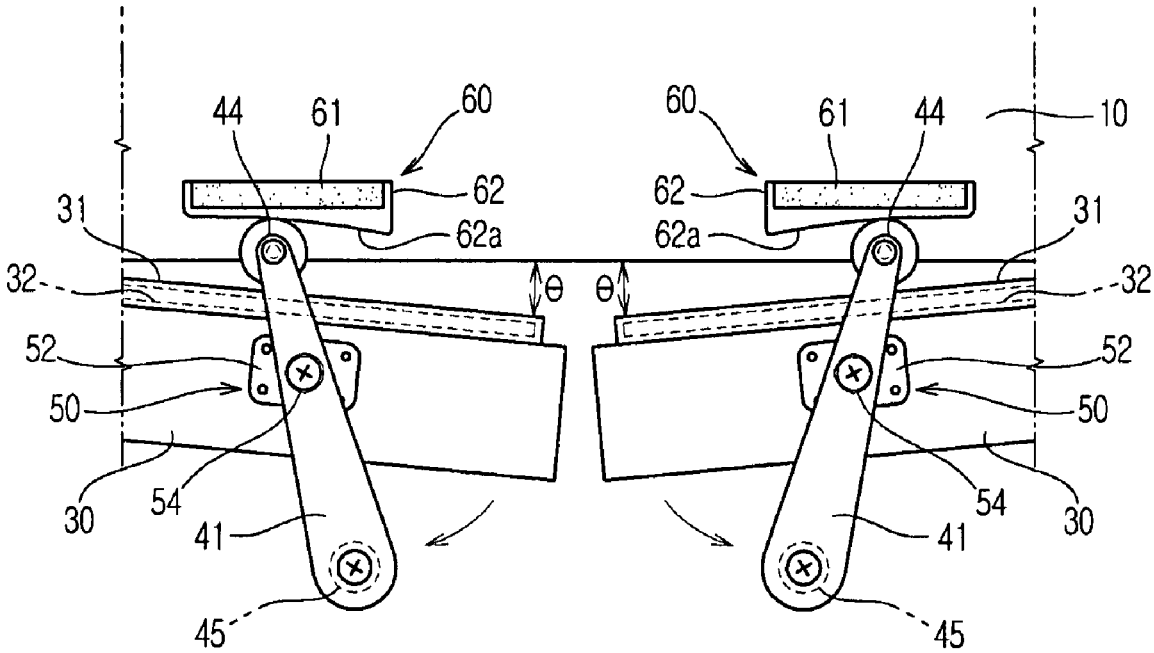
FIGS. 6 and 7 illustrate an operation of the door opening apparatus of FIG. 3.
Figure 7:
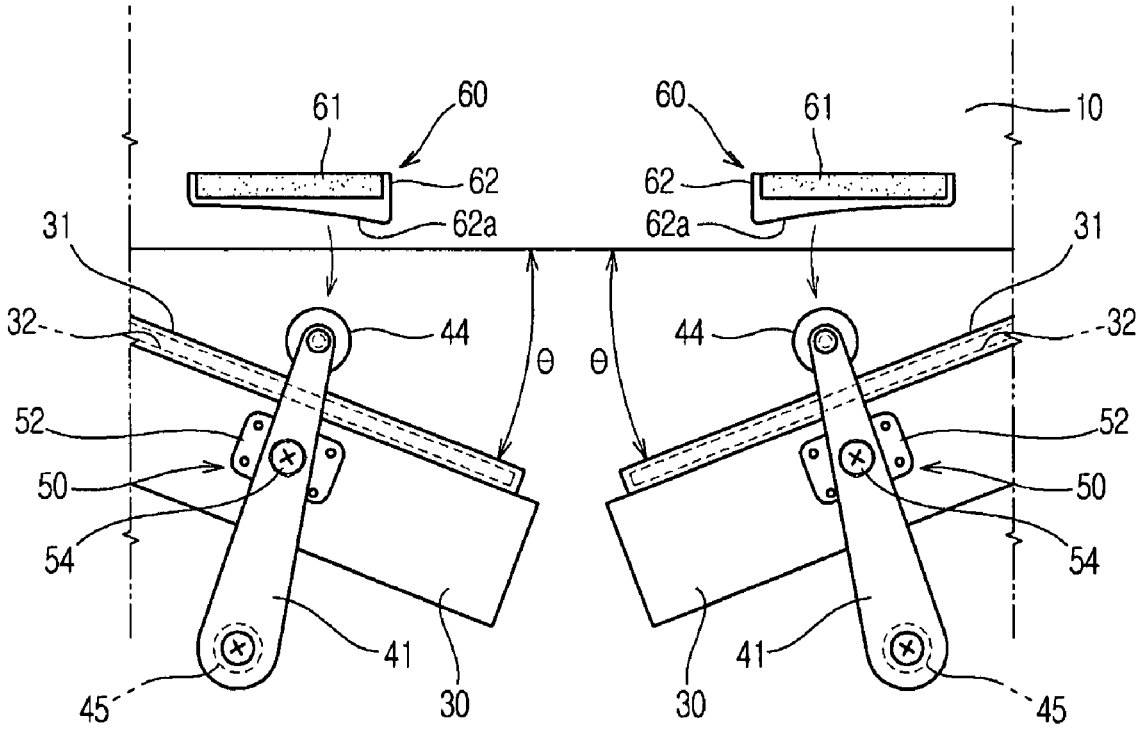

In this state, when the user pulls the door handle 45 to open the door 30, the rotational moment acts on each operating lever 41 as illustrated in FIG. 6. As a result, each operating lever 41 rotates about the coupling shaft 54, and the roller 44 installed to one end of each operating lever 41 rolls along the inclined surface 62*a* of the guide member 60. In this manner, when the roller 44 rolls to rise along the inclined surface 62*a*, each operating lever 41 is pushed in a forward direction of the main body 10 by the interaction between the roller 44 and the corresponding guide member 60. Thereby, part of the gasket 31 which is farthest from the upper and lower hinges 33 and 34 is separated from the main body 10, and thus a gap is generated between the door 30 and the main body 10. External air flows into the storerooms 20 through this gap, so that the storerooms 20 have the same pressure as the outside in an instant. However, although the gasket 31 is separated from the main body 10, the door 30 is not open abruptly.

This is because, although the roller 44 goes up along the inclined surface 62*a* to increase the distance from the magnet 61, the magnetic binding force still remains between the roller 44 and the magnet 61 to a certain extent, and thus the roller 44 is in contact with the inclined surface 62*a* of the guide member 60.

In this state, when the user further pulls the door handle 45, each operating lever 41 is further rotated, and thus the distance between the roller 44 and the magnet 61 is further increased. In this manner, when the distance between the roller 44 and the magnet 61 is increased to cause the magnetic binding force between the roller 44 and the magnet 61 to be weaker than the force of the user pulling the door handle 45, the roller 44 is completely separated from the inclined surface 62*a* of the guide member 60, as illustrated in FIG. 7.

According to an exemplary embodiment, there is a correlation between a rotation angle θ of a door 30 and force of a user pulling the door 30.

To rotate each door 30 from the main body 10, the user must gradually increase the force pulling the door handle 45. As the user gradually increases the force pulling the door handle 45, the flexible gasket 31 is expanded. The moment the force of the user pulling the door handle 45 reaches a peak (point A), the gasket 31 separates from the main body 10. But the force of the user pulling the door handle 45 is not abruptly decreased, but rather, smoothly decreased. This is because, even after the gasket 31 is separated from the main body 10, the magnetic binding force still remains between the roller 44 and the magnet 61, so that as the rotation angle θ of the door 30 increases, the magnetic binding force is gradually decreased between the roller 44 and the magnet 61. Therefore, the door 30 is opened smoothly rather than abruptly, and thus the user has a good tactile feeling when opening the door 30.

Meanwhile, in the state where the user opens the door 30, the elastic member 53 is twisted and compressed by the rotation of the operating lever 41. Hence, when the user sets the door handle 45 free, both the operating lever 41 and the door handle 45 return to their original positions because the elastic restoring force of the elastic member 53. In this state, when the door 30 is shut again, the magnetic binding force is generated between the magnet 32 in the gasket 31 and the main body 10, and between the roller 44 and the magnet 61, so that the gasket 31 is in close contact with the main body 10. Thus, the inside of each storeroom 20 is maintained in a sealed state, so that the cold air of each storeroom 20 is not leaked outside.

Up to now, the embodiment in which the magnet 32 is mounted in the gasket 31 has been described by way of example. But according to another embodiment, the magnet 32 is not mounted in the gasket 31. When the magnet 32 is not mounted in the gasket 31, the magnetic binding force is adapted to be further increased between the roller 44 and the magnet 61 to allow the gasket 31 to be in close contact with the main body 10.

Figure 8:
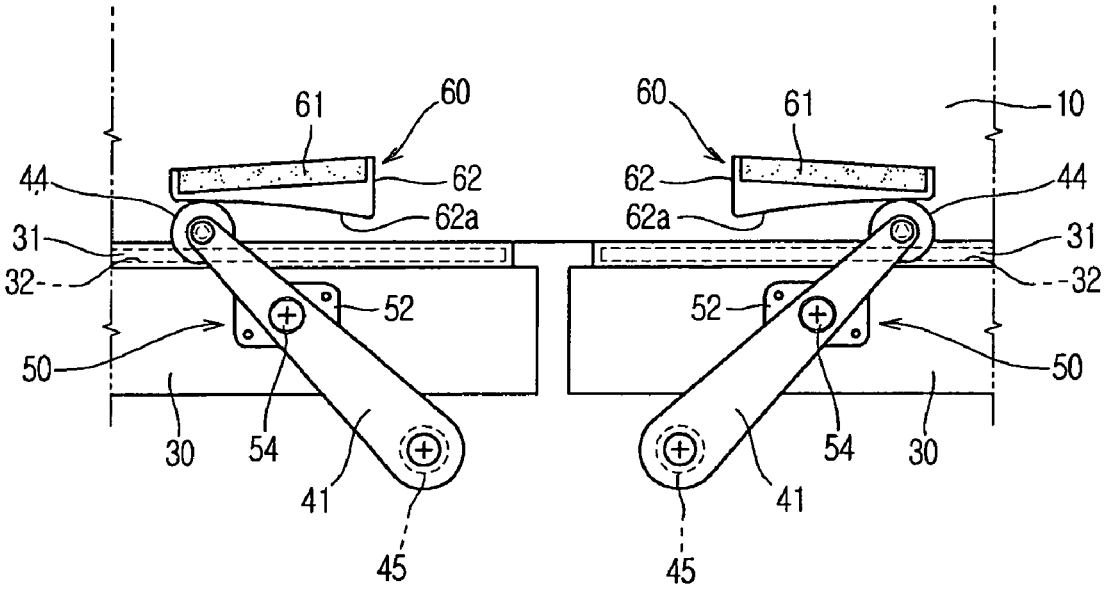
FIG. 8 is a plan view of a guide member according another embodiment of the present invention.

FIG. 8 is a plan view illustrating a guide member guiding rolling motion of a roller according to another embodiment of the present invention.

As illustrated in FIG. 8, a guide member 60 according to another embodiment of the present invention is installed to be inclined from front to rear of the main body 10 as the magnet 61 approaches from a start position to an end position of the inclined surface 62*a*.

Therefore, as the roller 44 moves up along the inclined surface 62*a*, the distance between the roller 44 and the magnet 61 is increased in nearly direct proportion to the movement, while the magnetic binding force between the roller 44 and the magnet 61 is decreased in nearly direct proportion to the movement.

Figure 9:
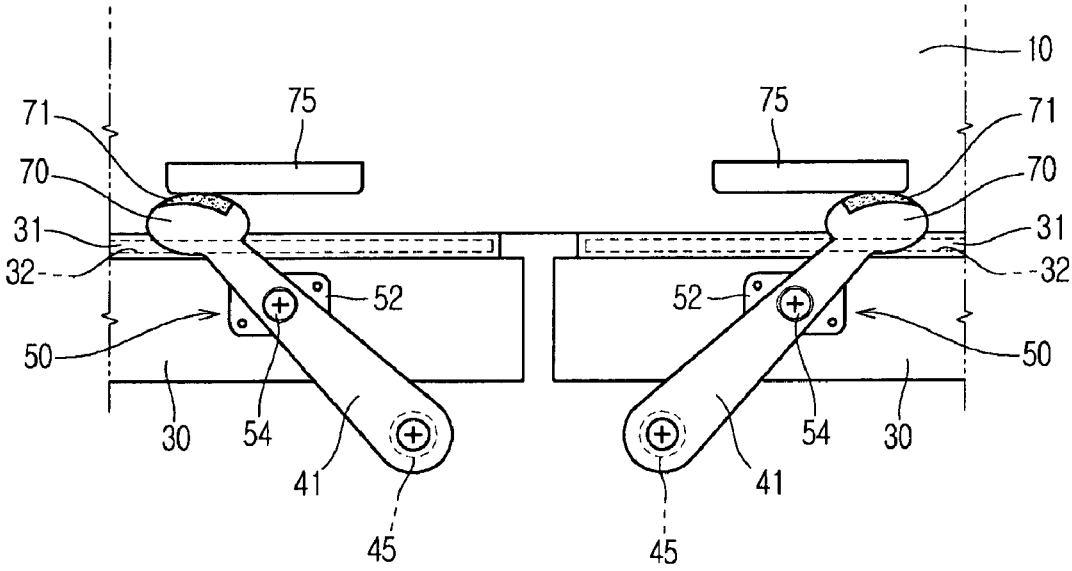
FIG. 9 is a plan view of a door opening apparatus according to another embodiment of the present invention.

FIG. 9 is a plan view illustrating a door opening apparatus according to another embodiment of the present invention.

A door opening apparatus 40 according to another embodiment of the present invention includes a contactor that is an elliptical cam 70 positioned at one end of the operating lever 41, and a metal plate 75 installed on an upper side of the main body 10. According to one embodiment, the cam 70 and the operating lever 41 are integrally formed as a one-piece construction.

The cam 70 has a length in a left-and-right direction longer than that of a fore-and-aft direction, and is provided with a magnet 71 at the rear thereof. Meanwhile, a thickness of the magnet 71 is gradually decreased along an opening rotating direction of the cam 70, such that each door 30 is opened.

Figure 10:
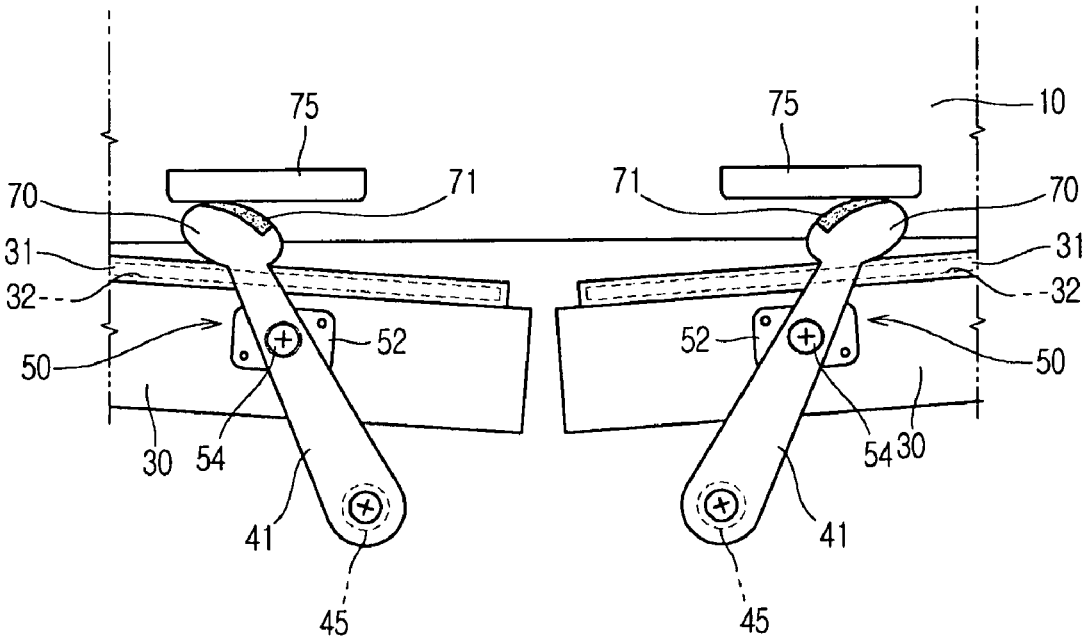
FIG. 10 illustrates an operation of the door opening apparatus of FIG. 10.

FIG. 10 is a plan view illustrating an operation of the door opening apparatus of FIG. 10.

When the user pulls the door handle 45 to open the door 30, the rotational moment acts on the operating lever 41, so that the operating lever 41 rotates about the coupling shaft 54. In this manner, when each operating lever 41 is gradually rotated, left- and right-hand faces of the cam 70 are gradually in contact with the plate 75. In other words, a contact surface (including the left and right hand faces) of the cam 70 slides across the plate 75.

Thus, the operating lever 41 is pushed in a forward direction of the main body 10 by the interaction between the cam 70 and the plate 75. Thereby, the gasket 31 is separated from the main body 10. However, although the gasket 31 is separated from the main body 10, the door 30 is not opened abruptly.

This is because, although the gasket 31 is separated from the main body 10, the magnetic binding force still acts between the magnet 71 of the cam 70 and the plate 75 to a certain extent.

But as the user further pulls the door handle 45, an increasingly thin portion of the magnet 71 is gradually in contact with the plate 75. Therefore, the magnetic binding force between the magnet 71 of the cam 70 and the plate 75 becomes increasingly weak, so that at a predetermined point, the cam 70 is completely separated from the plate 75, and the door 30 completely opens the front of the main body 10.

Figure 11:
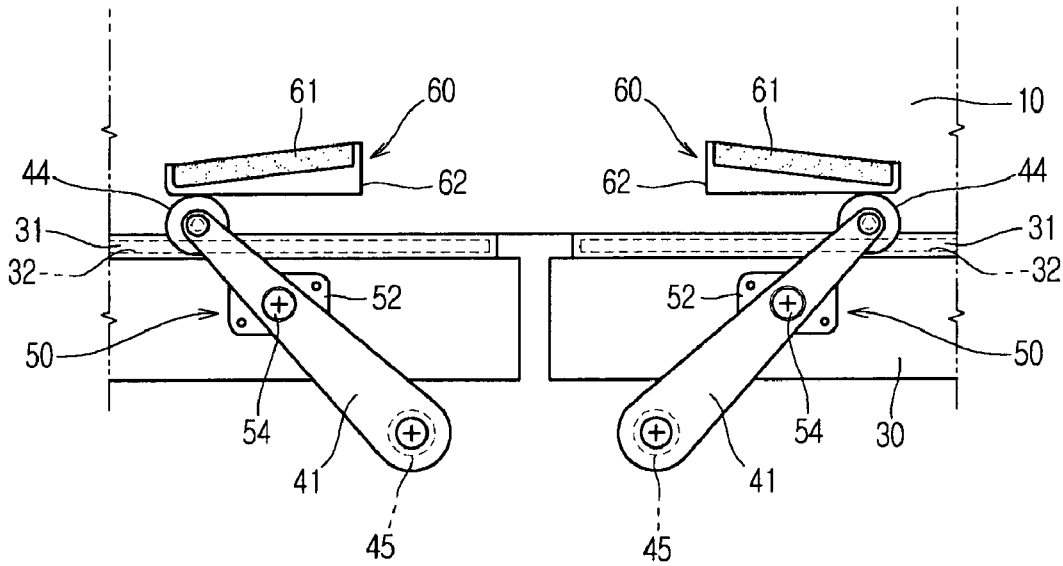
FIG. 11 is a plan view of a door opening apparatus according to yet another embodiment of the present invention.

FIG. 11 is a plan view illustrating a door opening apparatus according to yet another embodiment of the present invention.

As illustrated in FIG. 11, in a door opening apparatus according to yet another embodiment of the present invention, the cover 62 forming the guide member 60 has a front flat surface rather than a front inclined surface.

As the user pulls the door handle 45, the magnet 61 is inclined from front to rear of the main body 10 such that the distance between the roller 44 and the magnet 61 is increased. Thus, the door 30 is prevented from being open abruptly, and is opened smoothly.

Figure 12:
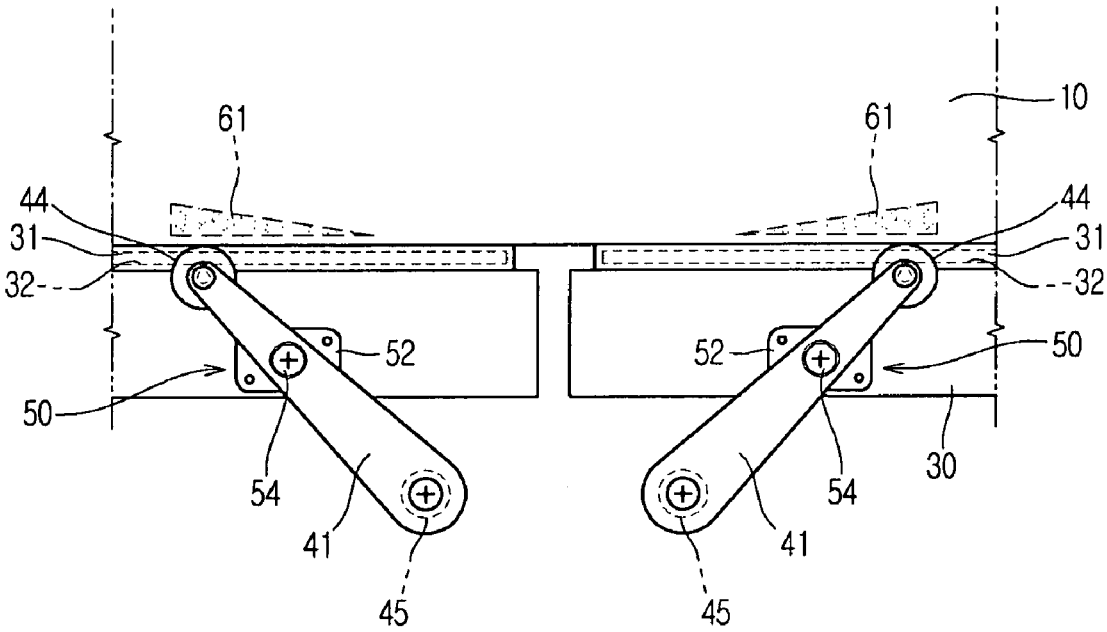
FIG. 12 is a plan view of a door opening apparatus according to still yet another embodiment of the present invention.

FIG. 12 is a plan view illustrating a door opening apparatus according to still yet another embodiment of the present invention.

As illustrated in FIG. 12, in a door opening apparatus according to still yet another embodiment of the present invention, the roller 44 is guided and rolled on a front surface of the main body 10. In other words, the front surface of the main body 10 acts as a guide member guiding the rolling motion of the roller 44.

Meanwhile, the magnet 61 forming the magnetic binding force with the roller 44 is mounted within the front surface of the main body 10. At this time, the magnet 61 is installed to have a gradually decreased thickness along the opening moving direction of the roller 44 such that the door 30 is opened. Thus, the door 30 is prevented from being opened abruptly, and is opened smoothly.

As described above, according to embodiments of the present invention, as the user pulls the door handle, the operating lever is pushed in a forward direction of the main body, and thus the door is separated from the main body. Accordingly, the user can easily open the door.

Further, the magnetic binding force still remains between the door and the main body to a certain extent in the state where the gasket of the door is separated from the main body, so that the door can be prevented from being open abruptly, and the user can improve a tactile feeling when opening the door.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A refrigerator comprising:
- a main body having at least one storeroom;
- at least one door hinged to the main body to open and close the storeroom; and
- a door opening apparatus configured to decrease a magnetic binding force between the door and the main body as a rotation angle of the door is increased, the door opening apparatus comprising
  - a pair of operating levers disposed at upper and lower ends of the door;
  - a door handle connecting the pair of operating levers and being disposed longitudinally in front of the door;
  - a roller rotatably coupled to one end of each operating lever;
  - a guide member installed to the main body and guiding a rolling motion of the roller, the guide member including a cover having a guide surface, the guide surface being inclined and curved to form part of a locus drawn by the roller when the operating lever rotates; and
  - a pair of coupling units rotatably coupling the pair of operating levers at the upper and lower ends of the door,
  - wherein the guide member includes a magnet to provide the magnetic binding force with the roller and the cover surrounding the magnet has an inclined surface to increase a distance between the roller and the magnet as each operating lever is rotated to open the door.

2. The refrigerator as claimed in claim 1, further comprising a gasket in which the magnet is mounted, is the gasket being attached on a rear surface of the door to be in close contact with a front surface of the main body.

3. The refrigerator as claimed in claim 1, wherein:
- the door has a pair of receiving recesses respectively formed on the upper and lower ends thereof; and
- each of the coupling units comprises
  - a supporting member fitted into one of the receiving recesses and supporting one of the operating levers,
  - an elastic member installed to the supporting member and causing the operating lever and the door handle to return to their original positions, and
  - a coupling shaft rotatably fixing the operating lever to the supporting member.

4. The refrigerator as claimed in claim 3, wherein a distance between the door handle and the coupling shaft is greater than that between the coupling shaft and the roller.

5. The refrigerator as claimed in claim 3, wherein each supporting member comprises:
- a flange positioned on an first end thereof, the flange having a plurality of holes for screws to fix the supporting member to the door; and
- an insert positioned on a second end thereof opposite the first end, the insert being inserted into one of the receiving recesses.

6. A refrigerator comprising:
- a main body having at least one storeroom;
- at least one door hinged to the main body to open and close the storeroom, and provided on a rear surface thereof with a gasket in close contact with the main body when the door is closed;
- a door handle;
- operating levers coupled with the door handle, rotationally coupled with the door, and capable of being rotated by manipulation of the door handle;
- a roller rotatably coupled to one end of each operating lever;
- a guide member installed to the main body and guiding a rolling motion of the roller; and
- a first magnet installed on one of the main body and the door, the guide member comprising:
  - a second magnet forming the magnetic binding force with the roller, and
  - a cover surrounding the second magnet and having an inclined surface to increase a distance between the roller and the second magnet as each operating lever is rotated to open the door,
  - wherein an upper surface of the main body and an upper surface of the door are disposed proximate to a horizontal plane,
  - wherein the operating levers and the roller are disposed above both the main body and the door, and
  - wherein the guide member is protruded from the upper surface of the main body such that the roller can contact with the guide member.

7. The refrigerator as claimed in claim 6, wherein the second magnet is installed on the main body, has a predetermined thickness, and is inclined from a front to a rear of the main body.

8. The refrigerator as claimed in claim 6, wherein the roller is guided and rolled on a front surface of the main body as the door handle is pulled.

9. The refrigerator as claimed in claim 8, wherein the second magnet is mounted within the front surface of the main body, and has a gradually decreased thickness along an opening moving direction of the roller.

wherein the second magnet is installed to have a gradually decreased thickness along an opening rotating direction of the cam,

10. The refrigerator as claimed in claim 6, wherein the gasket is attached on the rear surface of the door to be in close contact with a front surface of the main body when the door is closed.

11. A door opening apparatus in combination with a refrigerator comprising:

a door handle;

operating levers coupled with the door handle, rotatably coupled with a door of the refrigerator, and capable of being rotated by manipulation of the door handle;

coupling units rotatably coupling the operating levers at upper and lower ends of the door, respectively; a first magnet installed on at least one of a refrigerator main body and the door;

a pair of rollers rotatably coupled to one end of each operating lever; and a pair of guide members installed to the main body and guiding a rolling motion of the rollers;

the guide members comprising:

a pair of second magnets forming the magnetic binding force with the rollers; and a pair of covers surrounding the second magnets and having an inclined surface to increase a distance between the rollers and the second magnets as each operating levers are rotated to open the door, wherein a upper surface of the main body and a upper surface of the door are disposed proximately a horizontal plane, wherein the operating levers and the rollers are disposed above both the main body and the door, wherein the guide members are protruded from the upper surface of the main body.

12. The door opening apparatus as claimed in claim 11, wherein:

the door has a pair of receiving recesses respectively formed on the upper and lower ends thereof; and each of the coupling units comprises a supporting member fitted into one of the receiving recesses and supporting one of the operating levers, an elastic member installed to the supporting member and causing the operating lever and the door handle to return to their original positions, and a coupling shaft rotatably fixing the operating lever to the supporting member.

13. The door opening apparatus as claimed in claim 12, wherein each supporting member comprises:

a flange positioned on an first end thereof, the flange having a plurality of holes for screws to fix the supporting member to the door; and an insert positioned on a second end thereof opposite the first end, the insert being inserted into one of the receiving recesses.

14. The door opening apparatus as claimed in claim 13, wherein the insert is provided therein with a cylindrical shaft coupler which is concentric with an outer circumference of the insert, has a diameter smaller than the outer circumference of the insert, and to which the coupling shaft is coupled.

15. A door opening apparatus in combination with a refrigerator, comprising:

a pair of operating levers rotatably coupled to opposing ends of a refrigerator door hingedly connected to a refrigerator main body;

a handle coupled between respective first ends of the operating levers;

a pair of contactors respectively disposed at second ends of the operating levers, opposite to the first ends, each contactor comprising a roller rotatably disposed at the second end of the respective operating lever;

a pair of guide members having a pair of guide surfaces disposed on the main body and corresponding to the pair of contactors, each of the guide surfaces isbeing inclined and curved to form part of a locus drawn by the corresponding contactor when the corresponding operating lever rotates; and a pair of magnets disposed on one of the main body and the pair of contactors, wherein the magnets are respectively disposed within the pair of guide members and the guide surfaces are respectively disposed on the guide members.

16. The door opening apparatus as claimed in claim 15, wherein each guide surface is inclined to increase a distance between the corresponding roller and magnet as the door is opened.

17. The door opening apparatus as claimed in claim 16, wherein each magnet is inclined with respect to a front of the main body.

18. The door opening apparatus as claimed in claim 15, wherein each guide surface is substantially parallel to a front of the main body and the corresponding magnet is inclined to increase a distance between the corresponding roller and magnet as the door is opened.

19. The door opening apparatus as claimed in claim 15, wherein:

the guide surfaces are disposed on a front of the main body; and the magnets are disposed within the main body, and have a gradually decreased thickness along an opening moving direction of the roller.

* * * * *

UNITED STATES PATENT AND TRADEMARK OFFICE

CERTIFICATE OF CORRECTION

PATENT NO. : 8,132,876 B2
APPLICATION NO. : 11/822382
DATED : March 13, 2012
INVENTOR(S) : Jae Koog An et al.

It is certified that error appears in the above-identified patent and that said Letters Patent is hereby corrected as shown below:

First Page Column 1 Item 75 (Inventors), Line 1, Delete "Gwanglu (KR)" and insert -- Gwangju (KR) --, therefor.

Column 9, Lines 1-3, In Claim 9, after "roller." delete "wherein the second magnet is installed to have a gradually decreased thickness along an opening rotating direction of the cam,".

Column 10, Line 22, In Claim 15, delete "isbeing" and insert -- being --, therefor.

Signed and Sealed this
Twenty-ninth Day of May, 2012

David J. Kappos

David J. Kappos
*Director of the United States Patent and Trademark Office*